United States Patent [19]

Tachibana et al.

[11] 3,963,634

[45] June 15, 1976

[54] POWDERY BLEACHING DETERGENT COMPOSITION

[75] Inventors: Kyozaburo Tachibana, Sakura; Takashi Fujino, Yokohama, both of Japan

[73] Assignee: Kao Soap Co., Ltd., Tokyo, Japan

[22] Filed: Apr. 15, 1974

[21] Appl. No.: 460,911

[30] Foreign Application Priority Data

Apr. 17, 1973 Japan ..... 48-43331

[52] U.S. Cl. ..... 252/96; 252/97; 252/99; 252/186

[51] Int. Cl.[2] ..... C11D 9/42

[58] Field of Search ..... 252/95, 99, 186, 96, 252/97, 108, 109, 121, 132, 530, 531, 534, 539, 549, 550, 553, 558, 89, DIG. 1

[56] References Cited

UNITED STATES PATENTS

| | | | |
|---|---|---|---|
| 3,639,248 | 2/1972 | Moyer et al. | 252/99 X |
| 3,661,789 | 5/1972 | Corey et al. | 252/99 X |
| 3,684,271 | 2/1975 | Stalter | 252/99 |

*Primary Examiner*—Thomas J. Herbert, Jr.
*Assistant Examiner*—Bruce H. Hess
*Attorney, Agent, or Firm*—Woodhams, Blanchard and Flynn

[57] ABSTRACT

A powdery bleaching detergent composition consisting of detergent component(s) and sodium percarbonate, characterized in that at least 60% by weight of said detergent component(s) has particle diameters larger than 250 $\mu$, the copper content being less than 2 ppm and the iron content being less than 5 ppm, and at least 60% by weight of said sodium percarbonate having particle diameters larger than 250 $\mu$.

2 Claims, No Drawings

POWDERY BLEACHING DETERGENT COMPOSITION

BACKGROUND OF THE INVENTION

1. FIELD OF THE INVENTION

The present invention relates to a bleaching detergent composition, containing sodium percarbonate stably incorporated therein stably, and, more particularly, it relates to a powdery bleaching detergent composition comprising a powdery detergent having a particular particle size distribution, low contents of heavy metals and sodium percarbonate of a particular particle size distribution.

2. DESCRIPTION OF THE PRIOR ART

Though the process of mixing a detergent with sodium percarbonate for providing a better bleaching effect is known, the thus obtained mixture is inferior in its storage stability and during storage it loses available oxygen to reduce its bleaching capacity. This storage stability largely depends on the ambient temperature, the humidity in air and the moisture in the detergent, etc.

The powdery detergent products available in the Japanese market are generally highly porous and, different from the products of high apparent densities, they are more susceptible to temperature changes. Thus, a special caution is required to protect sodium percarbonate from a hot and humid climate.

Powdery detergents generally contain moisture in some amount, which will depend on the method of preparation, from the time of manufacture. In a territory such as Japan where the ambient humidity fluctuates largely and the mean ambient temperature is relatively high, the detergent particles repeatedly absorb and evaporate moisture so that an equilibrium is attained between the ambient moisture and the moisture in the detergent particles, and this equilibrium moisture varies in a range of from several percents to ten or more percents.

Though the bleaching effect of sodium percarbonate when it is used in a washing process at a low temperature is relatively excellent and its stability is high when the moisture content in the detergent is small, it becomes remarkably unstable when the moisture content in the detergent is increased. On the other hand, sodium perborate, also known as an oxidant-type bleaching agent, is often incorporated with a detergent and is considerably good in its storage stability, but it cannot accomplish a sufficient bleaching effect unless it is used at a high temperature above 60°C.

SUMMARY OF THE INVENTION

The object of the present invention, therefore, is to provide a powdery detergent composition in which, while maintaining The bleaching activity of sodium percarbonate at low temperatures as a characteristic feature of sodium percarbonate, the sodium percarbonate is stable even in case the moisture content in the detergent particles is high. We have found that the particle sizes of the detergent and sodium percarbonate and the metal contents in the detergent largely affect the stability of sodium percarbonate and have achieved the present invention.

The particle size distribution in conventional or commercially available powdery detergents ranges from several tens microns to several thousands microns. The particles of powdery detergents prepared by the spraydrying method, one of the methods for manufacturing powdery detergents, are so porous that they will be further crushed to fine particles by vibration during the process step for manufacturing the particles or in the course of transportation of the products, and, therefore, it will come to contain particles having a wide particle size range of from several microns to several thousands microns. In such powdery detergents, it has been found that the stability of sodium percarbonate can be improved by making the particle sizes of the detergent particles and sodim percarbonate particles in excess of a certain value.

On the other hand, it has been also known that, when an oxidant-type bleaching agent, for example, hydrogen peroxide, is dissolved in water, its decomposition will be accelerated by the presence of a slight quantity of metals. It is surprising, however, to find that the metals contained in the detergent particles influence greatly the stability of sodium percarbonate even in such a solid material as a mixture of the detergent with sodium percarbonate.

These metals which may deteriorate the stability of sodium percarbonate will be introduced from the starting materials for the detergent and the manufacturing process thereof and they include iron, copper, zinc, manganese and chromium, etc. In principle, the contents of all these metals should preferably be reduced, but, generally, 10 ÷ 50 ppm of iron and 5 – 10 ppm of copper are predominently contained in the detergent and other metals are found only in extremely slight quantities. Therefore the stability of sodium percarbonate will be enhanced by reducing the contents of iron and copper.

Thus the present invention relates to a bleaching detergent composition to which sodium percarbonate has been mixed with a high stability and, more particularly, it relates to a powdery bleaching detergent composition comprising a detergent component, consisting of an anionic or non-ionic surfactant or a mixture thereof, neutral or alkaline inorganic builders and other additives, and sodium percarbonate, wherein at least 60% by weight of said detergent component has particle diameters larger than 250 $\mu$, the copper content is less than 2 ppm and the iron content is less than 5 ppm, and at least 60% by weight of said sodium percarbonate has the particle diameters larger than 250 $\mu$.

As surfactants, there can be mentioned, for example, anionic surfactants such as sodium alkyl sulfates of 10 to 20 carbon atoms, sodium salts of higher fatty acids of 10 to 20 carbon atoms, sodium alkylbenzenesulfonates containing an alkyl group of 10 to 20 carbon atoms, sodium salts of polyoxyethylene alkyl ether sulfuric esters containing an alkyl group of 10 to 20 carbon atoms and sodium salts of polyoxyethylene alkylphenyl ether sulfuric esters containing an alkyl group of 6 to 10 carbon atoms; or nonionic surfactants such as polyoxyethylene alkyl ethers containing an alkyl group of 10 to 20 carbon atoms and polyoxyethylene alkylphenyl ethers containing an alkyl group of 6 to 10 carbon atoms.

As the neutral or alkaline inorganic builders, there can be mentioned, for example, sodium sulfate, sodium carbonate, sodium bicarbonate, polyphosphates such as sodium pyrophosphate and sodium tripolyphosphate and sodium silicate.

As other additives, there can be mentioned carboxymethyl cellulose, fluorescent dyes and perfumes.

As will be shown in the following Examples, the detergent component and the sodium percarbonate particles having particle diameters of less than 250 μ have insufficient stabilities and, even if the particle diameters are larger than 250 μ, high contents of iron and copper in the detergent component will deteriorate the stability of sodium percarbonate. Therefore, only by satisfying these two requirements simultaneously, an excellent stability of sodium percarbonate incorporated with powdery detergent can be obtained by their synergistic effect.

The present invention will be further described with reference to the following illustrative Examples.

EXAMPLE 1

| | % by weight |
|---|---|
| Sodium alkylbenzenesulfonate | 15.0 |
| Sodium tripolyphosphate | 30.0 |
| Sodium silicate | 5.0 |
| Sodium carbonate | 5.0 |
| Carboxymethyl cellulose | 1.0 |
| Fluorescent dye | 0.5 |
| Perfume | 0.2 |
| Sodium sulfate | 33.3 |
| Water | 10.0 |

A detergent having the composition as shown above was formed in samples having different particle sizes by the spray-drying and sieving process, and the respective samples were added with 10% by weight, based on the amount of the detergent, of sodium percarbonate having various particle sizes. The respective mixtures were left on standing in sealed vessels at a temperature of 40°C and a relative humidity of 80%, and the remaining available oxygen thereof was determined after 7 days. The contents of copper and iron in the above detergent used were 5 ppm of copper and 20 ppm of iron. The obtained results are shown in the following Table by the percentages against the amount of the initial available oxygen.

| Particle size of detergent* / Particle size of sodium percarbonate | less than 250 μ | 250–750 μ | more than 750 μ |
|---|---|---|---|
| less than 250 μ | 0% | 10% | 28% |
| 250–750 μ | 12% | 20% | 30% |
| more than 750 μ | 25% | 28% | 30% |

Note: *These values mean that the amounts of particles having particle sizes within the ranges of these numerical values are about 70% by weight of the samples.

The results in the above Table show that the storage stability of sodium percarbonate can be improved to some extent by making the particle sizes of the detergent as well as the sodium percarbonate to be more than 250 μ, but the remaining available oxygen of sodium percarbonate is only about 30% based on the initial available oxygen thereof, because of high contents of copper and iron in the detergent.

EXAMPLE 2

The powdery detergents of different particle sizes and having the same composition as in Example 1 but being varied with respect to the copper and iron contents were mixed with 10% by weight of sodium percarbonate containing more than 60% of the particles larger than 250 μ. The obtained mixtures were left on standing eight days in a sealed vessel at 40°C and under a relative humidity of 80% and then the remaining amounts of available oxygen of the mixtures were determined. The obtained results are shown in the following Table by the percentages against the amount of the initial available oxygen.

| Content of metal | | Particle sizes of detergent | | |
|---|---|---|---|---|
| Copper (ppm) | Iron (ppm) | less than 250 μ | 250–750 μ | more than 750 μ |
| 10 | 50 | 0 | 0 | 10 |
| 10 | 30 | 0 | 0 | 10 |
| 5 | 15 | 0 | 20 | 30 |
| 5 | 10 | 10 | 25 | 40 |
| 2 | 10 | 20 | 38 | 45 |
| 2 | 5 | 30 | 60 | 60 |

Ten (10) % by weight of sodium perborate having the following particle size distribution was added to the powdery detergent having the particle size of 250 – 750 μ and, after being left on standing for 8 days under the same conditions as above, the remaining available oxygen of the mixture was measured. The found value of remaining available oxygen was about 75%.

The employed sodium perborate had the following particle size distribution:

| | |
|---|---|
| more than 600 μ | 4.0% by weight |
| 600 – 150 μ | 78.0% by weight |
| 150 – 24 μ | 12.0% by weight |
| less than 24 μ | 6.0% by weight |

Accordingly, it will be apparent that, if the particle sizes of the detergent and sodium percarbonate were made to be above 250 μ and the contents of copper and iron in the detergent were made to be less than 2 ppm and 5 ppm, respectively, the storage stability of sodium percarbonate could be increased up to a substantially same level with that of sodium perborate.

The embodiment of the invention in which an exclusive property or privilege is claimed are defined as follows:

1. In a powdery bleaching detergent composition consisting of a mixture of particles of sodium percarbonate and detergent component, said detergent component consisting of a surfactant selected from the group consisting of anionic surfactants, nonionic surfactants and mixtures thereof, neutral or alkaline inorganic builders and other conventional detergent additives, the improvement which comprises; at least 60 percent by weight of said detergent component has particle diameters larger than 250μ, the copper content of said detergent component being less than 2 ppm and the iron content of said detergent component being less than 5 ppm, and at least 60% by weight of said sodium percarbonate has particle diameters larger than 250μ.

2. A composition as claimed in claim 1 in which said anionic surfactant is selected from the group consisting of sodium alkyl sulfates of 10 to 20 carbon atoms, sodium salts of higher fatty acids of 10 to 20 carbon atoms, sodium alkylbenzenesulfonates containing an alkyl group of 10 to 20 carbon atoms, sodium salts of polyoxyethylene alkyl ether sulfuric esters containing an alkyl group of 10 to 20 carbon atoms and sodium salts of polyoxyethylene alkylphenyl ether sulfuric esters containing an alkyl group of 6 to 10 carbon atoms, said non-ionic surfactant is selected from the group consisting of polyoxyethylene alkyl ethers containing an alkyl group of 10 to 20 carbon atoms and polyoxyethylene alkylphenyl ethers containing an alkyl group of 6 to 10 carbon atoms, and said builders are selected from the group consisting of sodium sulfate, sodium carbonate, sodium bicarbonate, sodium pyrophosphate, sodium tripolyphosphate and sodium silicate.

* * * * *